US010471464B2

(12) United States Patent
Arace et al.

(10) Patent No.: US 10,471,464 B2
(45) Date of Patent: Nov. 12, 2019

(54) COVERING ELEMENT AND METHOD FOR PROTECTING A PAINT-SENSITIVE AREA

(71) Applicant: LEONARDO S.P.A., Rome (IT)

(72) Inventors: Franco Arace, Venegono Superiore (IT); Luca Bottero, Olgiate Olona (IT); Massimo Gregori, Fagnano Olona (IT); Mirko Silvestri, Venegono Superiore (IT)

(73) Assignee: LEONARDO S.P.A., Rome (IT)

( * ) Notice: Subject to any disclaimer, the term of this patent is extended or adjusted under 35 U.S.C. 154(b) by 0 days.

(21) Appl. No.: 15/533,967

(22) PCT Filed: Dec. 17, 2015

(86) PCT No.: PCT/IB2015/059714
§ 371 (c)(1),
(2) Date: Jun. 7, 2017

(87) PCT Pub. No.: WO2016/098036
PCT Pub. Date: Jun. 23, 2016

(65) Prior Publication Data

US 2017/0341105 A1 Nov. 30, 2017

(30) Foreign Application Priority Data

Dec. 19, 2014 (IT) ..... TO2014A1071

(51) Int. Cl.
*B05D 1/32* (2006.01)
*B05B 12/26* (2018.01)

(52) U.S. Cl.
CPC ..... *B05D 1/32* (2013.01); *B05B 12/26* (2018.02)

(58) Field of Classification Search
None
See application file for complete search history.

(56) References Cited

U.S. PATENT DOCUMENTS 6,257,098 B1 * 7/2001 Cirone ..... B25B 13/56 81/119
6,328,260 B1 * 12/2001 Tarbox ..... B64C 3/18 244/123.1
2003/0224198 A1 12/2003 Cuyler et al.
2004/0056039 A1 * 3/2004 Sarajian ..... B05B 12/26 220/801

FOREIGN PATENT DOCUMENTS

DE 2611631 A1 10/1977
DE 19616449 C1 8/1997

OTHER PUBLICATIONS

International Search Report and Written Opinion from corresponding International Publication No. PCT/IB2015/059714, dated Mar. 31, 2016.

* cited by examiner

*Primary Examiner* — Xiao S Zhao
(74) *Attorney, Agent, or Firm* — Merchant & Gould P.C.

(57) ABSTRACT

A covering element is adapted to protect a paint-sensitive area wherein at least one opening is defined. The element includes a central stem having a distal portion intended to go through the opening, and a cap peripherally extending from a proximal portion of the central stem, for covering the area.

8 Claims, 4 Drawing Sheets

COVERING ELEMENT AND METHOD FOR PROTECTING A PAINT-SENSITIVE AREA

This application is a National Stage Application of International Patent Application No. PCT/M2015/059714, filed 17 Dec. 2015, which claims benefit of Serial No. TO2014A001071, filed 19 Dec. 2014 in Italy and which applications are incorporated herein by reference. To the extent appropriate, a claim of priority is made to each of the above disclosed applications.

TECHNICAL FIELD

The present invention relates to a covering element and method for protecting a paint-sensitive area.

In particular, the present invention relates to the masking or covering, with low environmental impact, of a paint-sensitive area, e.g. in aircraft components.

BACKGROUND ART

Painting complex assembled structures often requires protecting, e.g. masking or covering, sensitive or particular areas that do not have to be painted.

More in detail, according to the prior art, the protection of paint-sensitive areas is only limited to avoiding the use of some unsuitable or unadvisable techniques.

Such protection is ensured, for example, by avoiding inaccurate painting, in particular by means of a manual or automatic spray gun, which however would allow treating large surfaces in a short time.

Instead, where said protection is necessary, it is preferred to carry out a manual painting process by using suitably sized tools ensuring better precision in the application of the paint, which unfortunately drastically limits the dimensions of the surfaces that can be treated within a given time interval.

SUMMARY OF THE INVENTION

It is one object of the present invention to provide a covering element and method for protecting a paint-sensitive area, which can solve the problems of the prior art while at the same time being implemented in a simple and economical way.

It is to be understood that the appended claims are an integral part of the technical teachings provided in the following detailed description of the invention. In particular, the appended dependent claims define some preferred embodiments of the present invention which include some optional technical features.

Further features and advantages of the present invention will become apparent from the following detailed description, which is supplied by way of non-limiting example with particular reference to the annexed drawings, the contents of which will be summarized below.

DETAILED DESCRIPTION OF THE INVENTION

Figure 1:
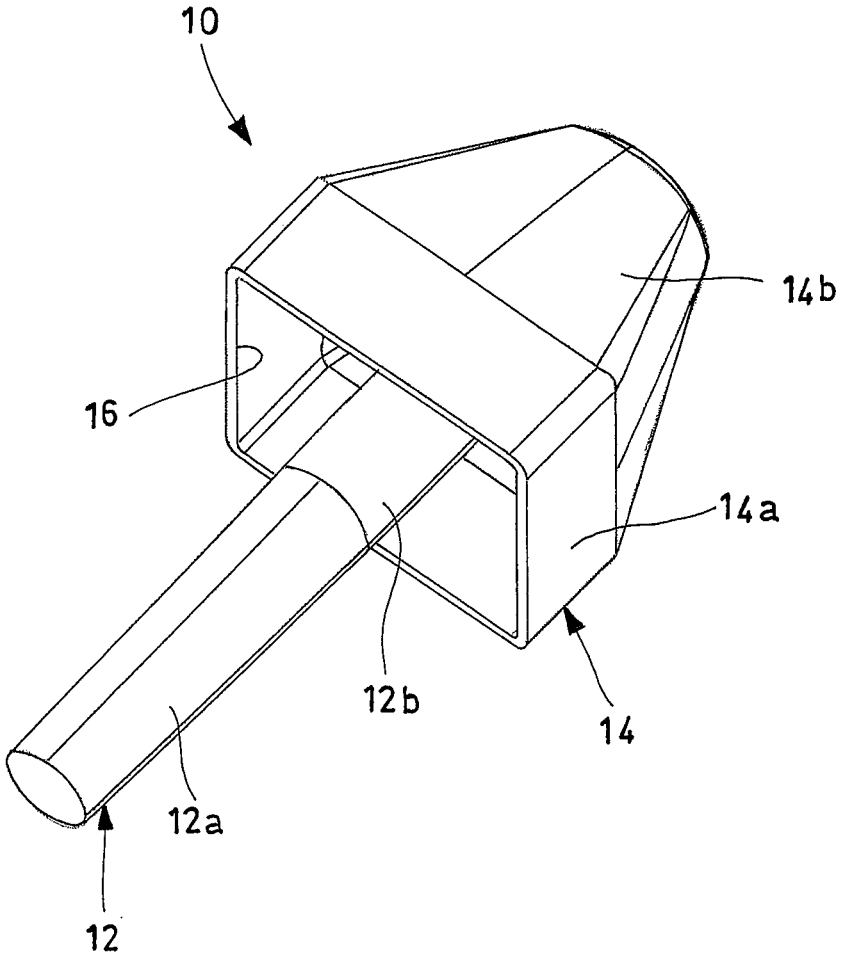
FIG. 1 is a perspective view of a covering element for protecting a paint-sensitive area, such element being obtained in accordance with an exemplary embodiment of the present invention.
Figure 2:
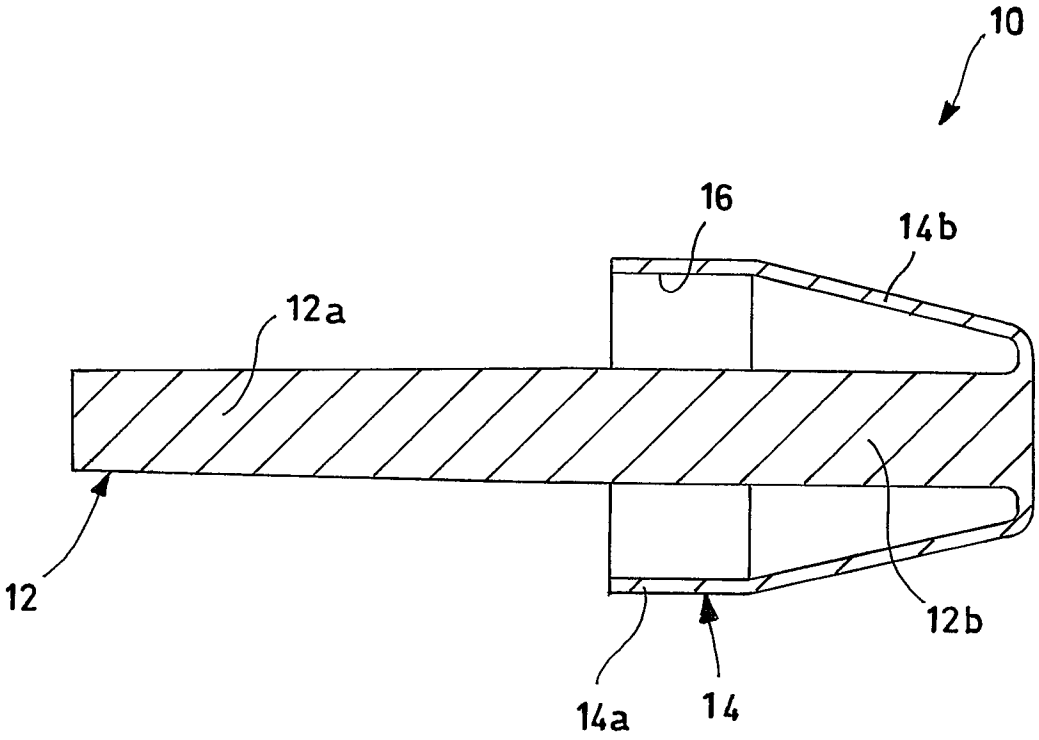
FIG. 2 is a longitudinal sectional view of the element shown in FIG. 1.

With particular reference to FIGS. 1 and 2, reference numeral 10 designates as a whole a covering element for protecting a paint-sensitive (i.e. unsuitable for painting) area A. In the above-listed drawings, element 10 is made in accordance with an exemplary and non-limiting embodiment of the present invention.

In particular, element 10 is suitable for application to a support S comprising said area A, in which a respective opening O is defined. Element 10 comprises:

- a central stem 12 having a distal portion 12*a* intended to go through opening O in area A that needs to be protected; and
- a cap 14 peripherally extending from a proximal portion 12*b* of central stem 12, for covering area A that needs to be protected.

As can be seen in the drawings, cap 14 internally delimits a cavity 16 facing towards stem 12 and extending around proximal portion 12*b*, in particular defining as a whole a substantially mushroom-like structure. More in particular, stem 12 protrudes, with its distal portion 12*a*, past cavity 16 defined by cap 14.

Preferably, the cross-section of cap 14 narrows or converges centrally, tapering towards the end of proximal portion 12*b*. In the illustrated embodiment, the cross-section of cap 14 has a prismatic part 14*a* with a constant cross-section (e.g. substantially quadrangular, in particular rectangular) and a substantially truncated conical part 14*b* extending from prismatic part 14*a* and having a cross-section that decreases towards the end of proximal portion 12*b*.

In the illustrated embodiment, element 10 is made of plastic material, e.g. by injection moulding. Element 10 can thus be manufactured at low cost.

Preferably, it is conceivable to use a plurality of elements 10 of different types having different predefined characteristics, properties and/or dimensions. In particular, each type of elements 10 may be designed to cover several areas A, possibly also associated or associable with different types of supports S to be subjected to machining and treatment. For example, elements 10 of different types may have different colours, each one of such colours referring to a different size of area A and/or of opening O. In particular, the different size may refer to the extension of cap 14 (e.g. related to the width of area A to be protected during the next painting step) and/or it may refer to the diameter of stem 12 (e.g. related to the width of opening O). This will make it easier for the operators to identify each element 10 to be specifically used for protecting a certain region of support S (or of different supports).

Figure 3:
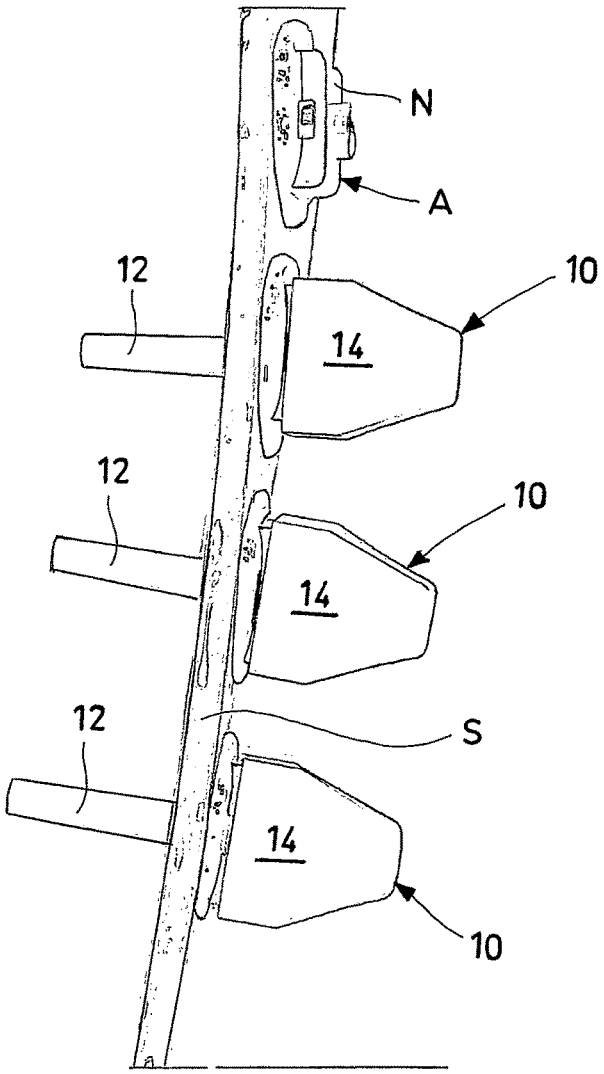
FIG. 3 is a schematic perspective view which illustrates a support whereon a plurality of covering elements, made in compliance with the preceding figures, is mounted.
Figure 4:
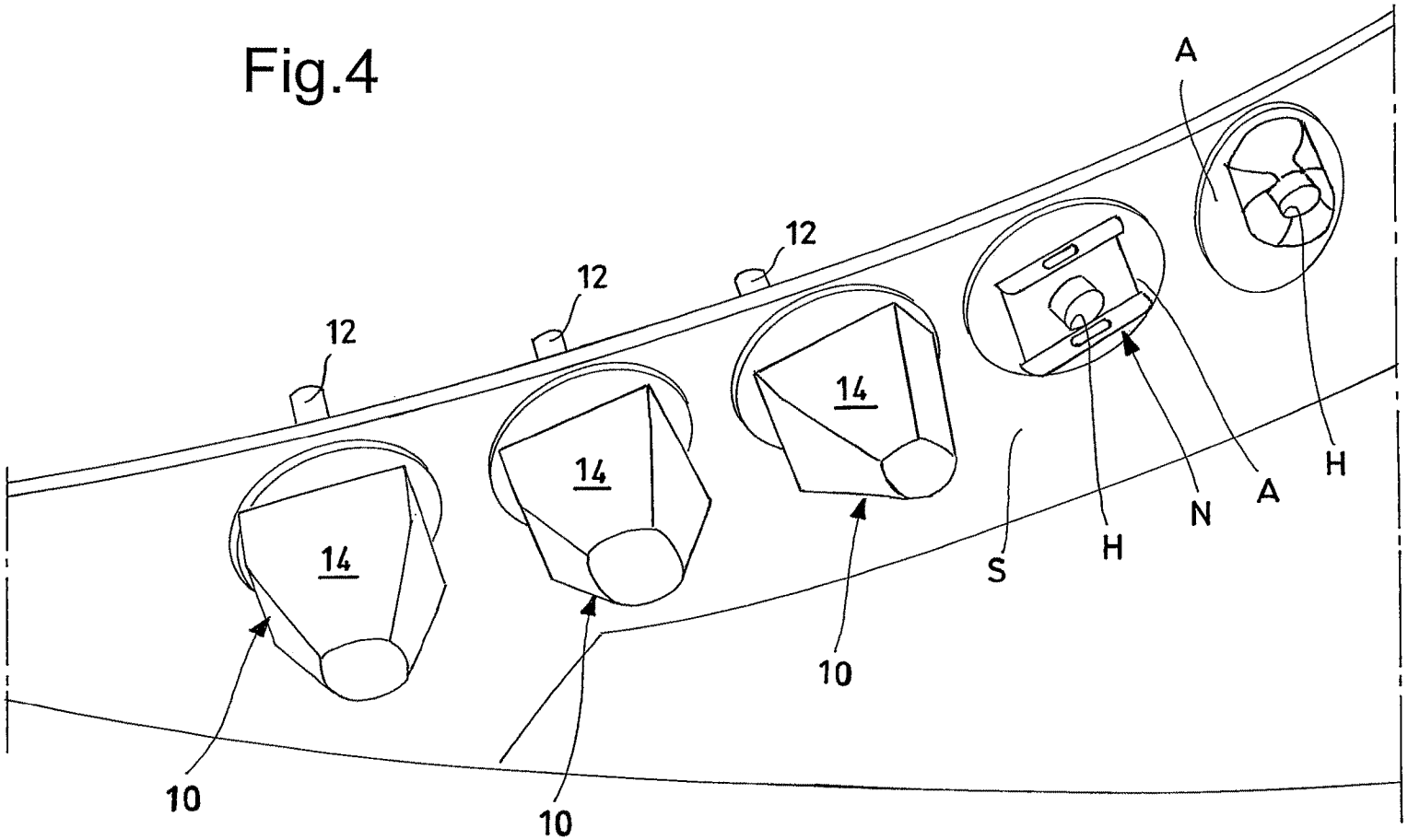
FIG. 4 is a perspective view, wherein a plurality of anchor nuts have been applied onto the support.

With particular reference to FIGS. 3 to 5, there is shown by way of example one possible application of elements 10. Said application concerns the aviation field, but a man skilled in the art will be aware that such an application should not be deemed to limit the protection scope of the present invention.

In FIGS. 3 and 4 a support S is visible, e.g. an aircraft structure such as a wing box, a spar, a rib, a stringer, a wing skin, or any other aircraft part suitable for receiving a screw connection, e.g. by means of an adhesive bonded nut plate (e.g. the models identified as CB3503 or CB6009). In particular, support S has a plurality of openings (not numbered), onto some of which a plurality of elements 10 is applied. As will be described below, each region around a respective opening, because it is paint-sensitive, is an area A that needs to be protected.

In a step of the method according to the present invention, each one of areas A is optionally intended to receive a mechanical fastening member, which in the illustrated embodiment is a respective anchor nut N. However, as it will be apparent to those skilled in the art, the mechanical fastening member may also be of a type other than the above-mentioned anchor nut; for example, it may be a nut, or in simplified variants of the present invention it may even be omitted.

Each anchor nut N has a respective hole H that must be aligned, during the assembling process, with corresponding opening O.

In the illustrated embodiment, each anchor nut N is assembled with respective area A, e.g. by glueing, prior to the next painting step. In this application it is important that anchor nut N is protected against the paint, since the latter might jeopardize its adaptability characteristics and the stability of the connection between said anchor nut N and support S. This problem is particularly felt when anchor nut N is of the so-called "floating" type, wherein the partial freedom of movement of said anchor nut might be impaired if its surface were painted.

In this embodiment, cavity 16 defined by cap 14 is appropriately shaped for covering anchor nut N, being superimposed on the latter.

In the illustrated embodiment, when assembling anchor nuts N, elements 10 are mounted onto support S, thus screening and covering paint-sensitive areas A that need to be protected. In particular, stem 12—with its distal portion 12*a*—is inserted through the respective opening (not numbered) in support S. In the illustrated embodiment, distal portion 12*a* also goes through hole H in anchor nut N mounted to the associated opening in support S.

Stem 12 can be inserted from above into the opening in support S and into hole H.

In this manner, entire support S can be subjected to a painting operation, even by means of a spray gun (or other methods not ensuring particular painting accuracy), without requiring the use of high-precision instruments or tools that might lead to significantly longer processing times.

In fact, the protection obtained through the use of cap 14 allows preventing the paint being applied from accidentally hitting and coating areas A that need to be protected, which in this case carry anchor nuts N.

After the painting step, elements 10 can be easily removed from support S, by extracting them by gripping cap 14 and/or by pushing stem 12 that protrudes past support S with its distal portion 12*b*.

Note that, according to the above-described method, it is advantageous to provide elements 10 with different visible markings (e.g. different colours) according to their overall dimensions, in particular those of cap 14 and/or of stem 12, depending on the specific application they are intended for.

In this manner, the operators will be able to immediately identify the correct type of elements 10 on the basis of the portions of support S whereon they will have to be mounted.

In fact, the operators will not have to select each element 10 to understand whether it is suitable or not for installation onto support S that will have to be subjected to the next painting treatment.

On the contrary, the operators will only have to take and use those elements 10 which have the correct marking for the intended use, without systematically having to select (typically by means of a dimensional check) the elements that are compatible with support S, rejecting the incompatible ones.

Of course, without prejudice to the principle of the invention, the forms of embodiment and the implementation details may be extensively varied from those described and illustrated herein by way of non-limiting example, without however departing from the scope of the invention.

The invention claimed is:

1. A method for protecting a paint-sensitive area, said method comprising the following operating steps:

providing a support carrying said area and having an opening in said area;

providing at least one element comprising a central stem having a distal portion adapted to go through said opening; and a cap peripherally extending from a proximal portion of said central stem, for covering said area; wherein said cap internally delimits a cavity facing towards said stem and surrounding said proximal portion;

inserting the distal portion of said central stem through said opening in a manner such that said cavity defined by said cap covers said area;

painting said support and said at least one element; and removing said at least one element from said support.

2. The method according to claim 1, wherein, prior to inserting said central stem through said opening, a mechanical fastening member is mounted on said sensitive area, the mechanical fastening member having a hole aligned with said opening; said distal portion going through both said opening and said hole.

3. The method according to claim 2, wherein said mechanical fastening member is an anchor nut.

4. The method according to claim 1, wherein said support is an aircraft structure including at least one element selected from the group consisting of: a wing box, a spar, a rib, a stringer, and a wing skin; said aircraft structure comprising a screw-type connection.

5. The method according to claim 1, wherein the at least one element is chosen from a plurality of different types, each one of said types being designed to cover and protect one corresponding area and being visibly marked in a different way than the other element types.

6. The method according to claim 1, wherein said cap is tapered towards said proximal portion.

7. The method according to claim 1, wherein said element comprises plastic material.

8. The method according to claim 1, wherein said element is manufactured by injection molding.

* * * * *